US007879433B1

(12) United States Patent
Felegi, Jr. et al.

(10) Patent No.: US 7,879,433 B1
(45) Date of Patent: Feb. 1, 2011

(54) ACOUSTICAL PANEL AND METHOD OF MAKING SUCH PANEL

(75) Inventors: John Felegi, Jr., Lancaster, PA (US); James R. Baxter, Lancaster, PA (US)

(73) Assignee: AWI Licensing Company, Wilmington, DE (US)

( * ) Notice: Subject to any disclaimer, the term of this patent is extended or adjusted under 35 U.S.C. 154(b) by 722 days.

(21) Appl. No.: 11/716,131

(22) Filed: Mar. 9, 2007

(51) Int. Cl.
*B32B 1/00* (2006.01)

(52) U.S. Cl. ..... 428/143; 181/290; 181/294

(58) Field of Classification Search ..... 428/143; 181/290, 294
See application file for complete search history.

(56) References Cited

U.S. PATENT DOCUMENTS 1,769,519 A 7/1930 King et al.
3,357,516 A * 12/1967 Cadotte et al. ..... 181/290
3,528,846 A * 9/1970 Celmer ..... 428/325
4,487,793 A * 12/1984 Haines et al. ..... 428/136
4,911,788 A 3/1990 Pittman et al.
5,071,511 A 12/1991 Pittman
6,103,360 A * 8/2000 Caldwell et al. ..... 428/323
6,616,804 B2 * 9/2003 Foster et al. ..... 162/129
6,749,920 B1 * 6/2004 Caldwell et al. ..... 428/105
2004/0062898 A1 4/2004 Felegi et al.
2005/0211500 A1 * 9/2005 Wendt et al. ..... 181/295

* cited by examiner

*Primary Examiner*—Alicia Chevalier

(57) ABSTRACT

A lightweight acoustical panel having a substantially monolithic appearance and high sound absorption capabilities is manufactured at a lower cost than acoustical panels having comparable properties. The panel is formed, punched with pins and coated with a coarse particle coating.

9 Claims, 1 Drawing Sheet

ACOUSTICAL PANEL AND METHOD OF MAKING SUCH PANEL

BACKGROUND OF THE INVENTION

The present invention relates generally to the field of fiberboard substrates. More particularly, the present invention relates to an acoustical panel having a substantially monolithic appearance with an acceptable noise reduction coefficient.

Fibrous acoustical panels are typically constructed using strong but relatively inexpensive materials such as newsprint paper, perlite, clays, mineral wool, and binder, such as starch. In order to achieve the requisite acoustical performance, the panel must be porous, especially on the surface of the panel. Examples of porous acoustical panels are described in U.S. Pat. Nos. 1,769,519; 4,911,788; and 5,071,511.

It is widely known in the industry that there is a balance between acoustical performance and visual aesthetics. A highly porous, low-density material may exhibit exceptional acoustical performance. However, such highly porous, low-density material tends to be fragile and difficult to handle and tends to exhibit poor durability, scrubability, tensile strength and, as a result, may not be visually appealing. The production processes and slurry recipes for acoustical panels are often manipulated in an attempt to balance these inherent tradeoffs.

For example, once the acoustical panel is formed, the panel can be further processed, e.g. embossed or punched with small holes, to further enhance the acoustical absorption capabilities of the panel while at the same time maintaining aesthetic appeal. An alternative technique for providing acoustical capabilities and aesthetic appeal is to laminate additional layers of material to the base panel. Generally, the acoustical performance of the laminated panel is largely a function of the soft, acoustically absorbent inner layer, while the outer layer which faces the room enhances the panel's durability, scrubability, and aesthetics. While laminated panels provide a good balance between performance, durability and visual aesthetics, such panels are relatively expensive to manufacture as the outer layer material usually is a high-cost constituent and lamination requires additional machinery, materials, and human resources.

U.S. Pat. No. 6,103,360 describes yet another attempt to provide a panel having high acoustical capabilities. Here, a coating composition which includes water, a binder and filler is placed on the acoustical panel. The filler contains particles having three different sizes. Due to the presence of the different sized particles, the coating composition is both durable and provides for high light reflectance. The coating is discontinuous, i.e. porous, enabling sound to pass through to an acoustical substrate. Similarly, U.S. Patent Application Publication No. 2004/0062898 describes a coating composition having filler particles, a binder and a liquid carrier. The filler particles are of a sufficient size to impart a textured appearance to the substrate. The coating composition preserves the acoustic performance characteristics of the substrate to which it is applied, while imparting a textured appearance to the substrate, making the substrate virtually indistinguishable from the surrounding panels.

However, the need remains for an inexpensively produced, fibrous substrate which has a monolithic appearance, a high light reflectance value and high sound absorption capabilities.

SUMMARY OF THE INVENTION

In accordance with the invention, a coated panel is provided. The coated panel includes a substrate having a thickness in the range from about 0.5 inches and 0.75 inches, a density in the range from about 1.25 to about 1.7 lbs/board foot and a porosity in the range from about 83.0% to about 90.0%. The substrate further includes perforations which extend through a top surface thereof and are present in an amount from about 500 to about 1750 perforations per square foot. The average perforation diameter is in the range from about 0.035 to about 0.055 inches. The panel has a coating which is applied to the top surface of the substrate. The coating includes coarse particles which have an average particle size in the range from about 250 to about 750 microns and which are present in an amount in the range from about 45 to about 80 grams per square foot. The coated panel has a noise reduction coefficient in the range from about 0.575 to about 0.725 and a light reflectance value in the range from about 0.82 to about 0.88.

In another aspect of the present invention, a method of making the acoustical panel comprises forming a substrate; perforating the substrate; coating the substrate with at least one face coating; coating the perforated substrate and the at least one face coating with coarse particles to produce low cost, acoustical panel having a monolithic appearance.

Additional objects, features, and advantages of the invention will become more apparent upon review of the detailed description set forth below when taken in conjunction with the accompanying drawing figures, which are briefly described as follows.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE INVENTION

Figure 2:
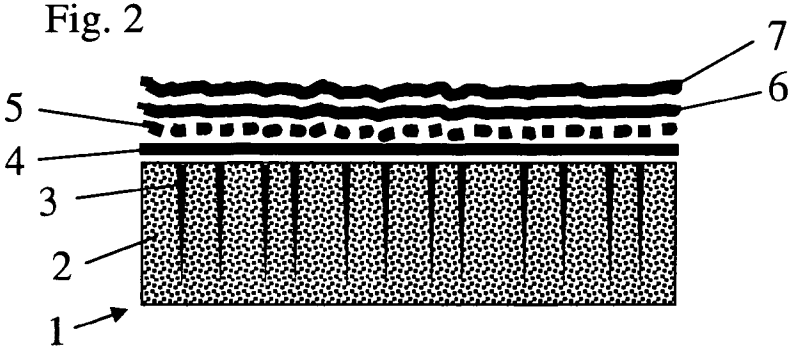
FIG. 2 is an exploded cross-sectional view of the coated panel of FIG. 1.
Figure 1:
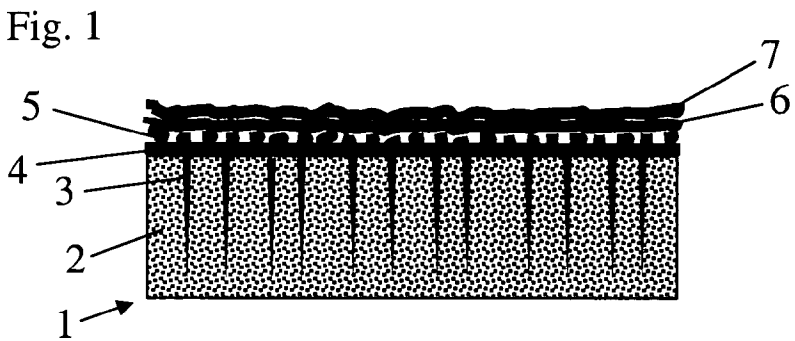
FIG. 1 is a cross-sectional view of a coated panel according to an example embodiment of the present invention.
Figure 3:
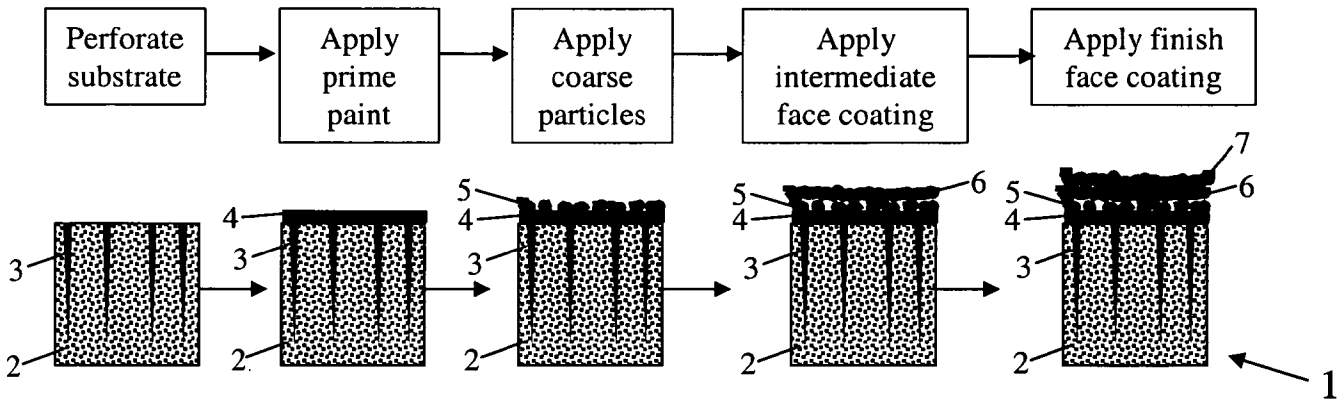
FIG. 3 is a flow diagram of a process in accordance with the formation of the example embodiment illustrated in FIGS. 1 and 2.

The invention and various embodiments thereof are presented in FIGS. 1-3 and the accompanying descriptions wherein like numbered items are identical. Referring first to FIGS. 1 and 2, a coated panel 1 made in accordance with the present invention is shown. The coated panel includes a panel substrate 2 comprising from about 40 to about 85 dry wt. % fibrous filler and from about 4 to about 15 dry wt. % binder. In accordance with the present invention, the substrate 2 has a density from about 1.10 to about 1.70 lb./board ft., preferably from about 1.30 to about 1.40 lb/bd./ft., and a porosity of about 83% to about 90%, preferably from about 84 to about 85%.

The fibrous filler can be selected from mineral wool, fiberglass, rock wool, slag wool, and combinations thereof. In one example embodiment, the fibrous filler comprises metal slag wool. The binder may be selected from granular starches, such as pearl cornstarch, wheat starch, and potato starch, and from polymers which function as binders. Examples of such polymers include but are not limited to polystyrene, polyvinyl acetate, polystyrene acrylics, styrene butadiene, and combinations thereof. In one aspect of the present invention, granular pearl cornstarch comprises the binder.

To provide additional strength and sag resistance, the substrate 2 can further comprise from about 2 dry wt. % to about 10 dry wt. % of cellulose fibers. The cellulosic fibers are selected from primary wood fibers, secondary woods fibers, primary paper fibers, secondary paper fibers, or cotton linters.

Non-fibrous fillers may also be employed in the substrate in an amount from 0 to about 25 dry wt. %. The non-fibrous fillers can be selected from kaolin clay, calcium carbonate, silica, vermiculite, ball clay or bentonite, talc, mica, gypsum, and combinations thereof, to name only a few.

Expanded perlite can also be employed in the fiberboard in an amount from 0 to about 50 dry wt. %. Perlite contributes to the bulk and hardness of the fiberboard.

Additional water and "dry broke" may be added to the aqueous slurry forming the panel substrate 2. The "dry broke" is predominately recycled board material that may have been rejected or cut from the commercially acceptable boards, as well as other waste products. Dry broke may be employed in an amount from 0 to about 30 dry wt %.

Additional additives, such as dispersants, flocculants, defoaming agents, fungicides, biocides, and combinations thereof, may be added to the aqueous slurry which forms the fiberboard in an amount from 0 to about 1 dry wt. %. Such additives are known in the art and may be readily employed by those of ordinary skill in the art.

In the process of preparing the panel substrate, the aforementioned ingredients are mixed together with the amount of water necessary to provide slurry consistency in conventional mixing and holding equipment (not shown). In the present invention, sufficient water is added to form an aqueous slurry comprising from about 2 to about 13 wt. % solids. In one embodiment, the aqueous slurry comprises from about 2 to about 5 wt. % solids.

The coated panels are formed via a conventional wet-felting process. The substrate is formed and is face sanded to have a thickness in the range of about 0.55 to about 0.75 inches. The substrate is then perforated. The methods of perforation are well known to those of ordinary skill in the art and include pin punching. In addition, the combination of the number of pin perforations 3 per square foot as well as the diameter of the pin perforations 3 to achieve a desired acoustical performance is within the knowledge of one of ordinary skill in the art. Here, to condition the substrate, from about 500-1750, preferably 1100-1600, pins per square foot and have a diameter in the range of about 0.035-0.055 inches, and preferably 0.037-0.50 inches are used. In the examples which follow, the substrates were perforated with 0.40 inch diameter pins in an amount of 1600 pins per square foot to a depth of 0.065 inches from the back of the substrate.

The fabrication sequence is shown in FIG. 3. As shown, at least one face coating 4, which acts as a primer, is applied to the top surface of the substrate 2. One of ordinary skill in the art can easily select the primer 4 to be used. The primer 4 is applied in amount from about 17 to about 22 grams per square foot.

Coarse particles 5 having a particle size of about 250 to about 750 microns are then dropped onto the prime coat 4. The coarse particles 5 are applied to the panel in an amount in the range from about 45 to about 80 grams per square foot, and preferably in the range from about 55 to about 65 grams per square foot. The layer of coarse particles 5 provides texture to the surface of the substrate 2. Examples of course materials which can be used include, but are not limited to, calcium carbonate, dolomitic limestone and foamed glass. Most preferably, the coarse particles are calcium carbonate, such as the calcium carbonate particles available as Geotex TXS from the Huber Engineering Materials Company.

In the example embodiment shown in FIG. 3, two additional face coatings are added, namely an intermediate face coat 6 and a finish face coat 7. The type of face coating and its application are well within the purview of one of ordinary skill in the art. It is acceptable to modify the sequence such that one or more face coatings, e.g. face coats 6 and 7, are applied before the application of the coarse particles. The key is that the coarse particles are applied separately from these face coatings. The coarse particles disrupt the coatings applied after such the coatings have an inherent porosity allowing sound to enter through. The board porosity, coating porosity and the properties of the perforations are key to the NRC. Key to achieving a combination of high NRC, high light reflectance and low pin visibility is maintaining the components of pin density, pin size, board porosity and amount of coarse particles within the ranges set forth above.

Acoustical properties, e.g. sound absorption, of the coated panel are based upon sound entering the underlying panel substrate 2 through the coarse particle coating and the pores in the panel, including the pin perforations 3 in the top surface of the panel substrate. The coated panel of the invention has an NRC in the range from about 0.575 to about 0.725; and a light reflectance value in the range from about 0.82 to about 0.88.

EXAMPLES

Panels having the following composition were made via a wet-forming process as described above.

| Ingredient | Approx. Dry wt. % |
|---|---|
| Mineral Wool | 58.2 |
| Starch | 8.0 |
| Cellulose Fibers | 4 |
| Filler | 0 |
| Expanded Perlite | 27.5 |
| Dry Broke | 20 |
| Other | 0.3 |

Six panels having the above composition were sanded, punched with varying number of pins and pin diameters and were coated with coarse particle.

| | Sample 1 | Sample 2 | Sample 3 | Sample 4 | Sample 5 | Sample 6 |
|---|---|---|---|---|---|---|
| NRC of panel after sanding and prior to any fabrication | 0.673 | 0.688 | 0.68 | 0.64 | 0.60 | 0.6 |
| Number of pins per square foot | 525 | 1600 | 500 | 1600 | 1100 | 1100 |
| Pin | 0.050 | 0.040 | 0.040 | 0.040 | 0.050 | 0.040 |

-continued

| | Sample 1 | Sample 2 | Sample 3 | Sample 4 | Sample 5 | Sample 6 |
|---|---|---|---|---|---|---|
| Diameter (microns) | | | | | | |
| Finished Thickness (inches) | 0.695 | 0.695 | 0.690 | 0.695 | 0.790 | 0.790 |
| Amount of coarse particles (grams per square foot) | 65 | 65 | 65 | 65 | 65 | 65 |
| NRC of panel post grit application | 0.670 | 0.72 | 0.63 | 0.63 | 0.64 | 0.51 |
| Light Reflectance | 0.847 | 0.853 | 0.854 | 0.853 | 0.865 | 0.865 |

The amount of sound energy absorbed by a material is determined by a standardized test procedure ASTM C423-90a entitled "Standard Test Method for Sound Absorption and Sound Absorption Coefficients by the Reverberation Room Method". Tests having STC results are determined by an insertion loss as set forth in ASTM E 90. Light reflectance in Samples 1-6 was measured using a Datacolor International Spectroflash 600 with a large area view aperture set at Daylight 65 at 10 degrees. The porosity in Samples 1-6 was measured using the Micrometrics AccuPyc 1330 helium pycometer.

Each of Samples 1-6 illustrate the noise reduction coefficient of the perforated panel is not substantially reduced by the addition of the coarse particles, and, at the same time, a high light reflectance value can be achieved.

The embodiments described above and shown herein are illustrative and not restrictive. The scope of the invention is indicated by the claims rather than by the foregoing description and attached drawings. The invention may be embodied in other specific forms without departing from the spirit of the invention. Accordingly, these and any other changes which come within the scope of the claims are intended to be embraced therein.

We claim:

1. A coated panel comprising:

a substrate having a thickness in the range from about 0.5 inches and 0.75 inches, a density in the range from about 1.25 to about 1.7 lbs/board foot and a porosity in the range from about 83.0% to about 90.0%; the substrate having perforations extending through a top surface thereof, the perforations being present in an amount from about 500 to about 1750 perforations per square foot, wherein the average perforation diameter is in the range from about 0.035 to about 0.055 inches;

a coating layer applied to the top surface of the substrate; and a coarse particle layer applied on top of the coating layer, the coarse particle layer consisting essentially of coarse particles having an average particle size in the range from about 250 to about 750 microns, the coarse particle layer being present in an amount in the range from about 45 to about 80 grams per square foot;

wherein the coated panel has a noise reduction coefficient in the range from about 0.575 to about 0.725 and a light reflectance value in the range from about 0.82 to about 0.88.

2. The coated panel of claim 1, wherein the substrate comprises from about 40% to about 85% fibrous filler, from about 4% to about 15% binder, from about 2% to about 10% cellulosic fibers, from 0% to about 50% expanded perlite, on a dry wt. % basis.

3. The coated panel of claim 1, wherein said density of the substrate is in the range of about 1.30 to about 1.4 lb./bd. ft.

4. The coated panel of claim 2, wherein the fibrous filler comprises mineral wool, fiberglass, rock wool, slag wool, and combinations thereof.

5. The coated panel of claim 2, wherein said binder comprises granular starches, polystyrene, polyvinyl acetate, polystyrene acrylics, styrene butadiene, and combinations thereof.

6. The coated panel of claim 5, wherein said granular starches comprise pearl starch, wheat starch, and potato starch.

7. The coated panel of claim 2, wherein said panel further comprises non-fibrous fillers.

8. The coated panel of claim 7, wherein said non-fibrous fillers comprises kaolin clay, calcium carbonate, silica, vermiculite, ball clay or bentonite, talc, mica, gypsum, and combinations thereof.

9. The coated panel of claim 1, wherein the coating layer is present in an amount from about 17 to about 22 grams per square foot.

* * * * *